US009416529B1

(12) United States Patent
Jeske

(10) Patent No.: US 9,416,529 B1
(45) Date of Patent: Aug. 16, 2016

(54) EDGE OF SLAB ANCHOR APPARATUS AND SYSTEM

(71) Applicant: Stewart P. Jeske, Kansas City, MO (US)

(72) Inventor: Stewart P. Jeske, Kansas City, MO (US)

( * ) Notice: Subject to any disclaimer, the term of this patent is extended or adjusted under 35 U.S.C. 154(b) by 0 days.

(21) Appl. No.: 14/827,579

(22) Filed: Aug. 17, 2015

(51) Int. Cl.
*E04B 1/41* (2006.01)
*E04B 2/88* (2006.01)
*E04B 1/38* (2006.01)

(52) U.S. Cl.
CPC ... *E04B 1/41* (2013.01); *E04B 2/88* (2013.01); *E04B 2001/405* (2013.01)

(58) Field of Classification Search
CPC ..... E04B 1/41; E04B 2/88; E04B 2001/405; E04F 13/0826; E04F 2/96
USPC ..... 52/125.4, 235, 506.03, 510, 511
See application file for complete search history.

(56) References Cited

U.S. PATENT DOCUMENTS 3,951,371 A * 4/1976 Hoes ..... E04F 13/0855 248/220.21
4,350,318 A 9/1982 Gallis
5,720,571 A 2/1998 Frobosilo et al.
5,833,417 A * 11/1998 Sargent ..... F16B 37/046 248/58
5,860,257 A * 1/1999 Gerhaher ..... E04F 13/0826 52/235
6,170,214 B1 * 1/2001 Treister ..... E04F 13/0808 52/235
6,289,646 B1 * 9/2001 Watanabe ..... E04F 13/083 52/235
6,470,647 B2 * 10/2002 Hsueh ..... E04F 13/0812 52/235
7,104,024 B1 9/2006 diGirolamo et al.
7,478,508 B2 1/2009 Peterson
7,543,420 B2 * 6/2009 Holt ..... E04B 1/41 52/262
8,365,484 B2 2/2013 Foley
8,745,941 B2 * 6/2014 Macdonald ..... E04F 13/0825 52/235
8,973,316 B2 * 3/2015 Safford ..... E04B 2/885 52/204.62
2008/0222981 A1 9/2008 De Gobbi

* cited by examiner

*Primary Examiner* — Brian Glessner
*Assistant Examiner* — Adam Barlow
(74) *Attorney, Agent, or Firm* — Lathrop & Gage LLP

(57) ABSTRACT

Apparatus are provided for a curtain wall anchor system. The curtain wall anchor assembly may include various anchor assemblies. Each possible anchor assembly is intended to reduce labor time and costs and eliminate extraneous steps in the construction process involving curtain walls. Each possible anchor assembly also features an optional component of attaching a concrete anchor for optimizing load paths and solving issues of bending in traditional edge angle pour stops.

15 Claims, 5 Drawing Sheets

EDGE OF SLAB ANCHOR APPARATUS AND SYSTEM

TECHNICAL FIELD

The present disclosure relates to an apparatus and system for some adjustability for an edge of slab curtain wall anchor and for transferring the loads associated with the outer cladding of a building, commonly known as the curtain wall, to the structural elements of a building through anchors with specific points of attachment.

BACKGROUND

Curtain walls are the outer covering of a building in which the outer walls are non-structural, and merely keep the weather out and occupants of the building in the building. A curtain wall does not carry any dead load weight from the building other than its own dead load. In this context a dead load, or also commonly referred to as a static load, include loads that are relatively constant over time, including the weight of the structure itself, and immovable features such as walls, plasterboard or carpet. Curtain walls are designed to resist air and water infiltration, sway induced by wind and seismic forces acting on the building and its own static load weight forces. Exterior wind loads combined with the curtain wall's own weight are transferred to the building through, for example, anchors at specific points of attachment. Curtain walls may be attached to anchors via different methods. Typical curtain wall assemblies include structural members called mullions which separate and secure the curtain wall panels. The mullions are secured to the building via curtain wall anchors. Curtain wall anchors are the connection means between the curtain wall mullions to the building structure.

Typical building construction techniques with steel supported concrete floor slabs employ a bent steel plate fixed to spandrel beams as pour stops for concrete. The bent plate pour stops may also be referred to as edge angles. Considerable time is required at a steel fabricator to bend all of the plate to install as pour stops. The bent plate pour stops are then taken to the job site, positioned, and welded on top of the spandrel beams. Bent plates often provide a wavy edge of the slab with significant deviation of the actual edge from planed location. The deviation creates difficulties in attachment of a curtain wall while trying to maintain a controlled planar surface in the outer surface of the curtain wall. Additionally, the curtain wall is typically attached to the bent plate pour stop via clip angles welded to the pour stop or supporting beam. This requires considerable time and labor to position the curtain wall anchors and weld them in place. The welding also requires costly skilled laborers and adds significantly to the overall construction schedule.

Occasionally embedded anchor channels are specified for a building slab edge to allow for curtain wall attachment. These typically require cutting the steel pour stop and welding sections of anchor channel or block-outs for top mounted anchor channels in the concrete slab. Although these options allow for some adjustability for the curtain wall installation they still do not account for the wavy bent plate slab edge and they require significant coordination between construction trades in addition to being costly to install.

One of the concerns in using current art anchor channels welded to steel edge angles is that excessive loads can cause the edge angle to bend. Structural engineers are regularly confronted with this issue by contractors who want easier and faster construction techniques. The proposed curtain wall anchor system and embodiments include options for providing a direct or indirect load path into the concrete slab or steel beam to prevent edge angle bending.

SUMMARY

This summary is provided to introduce a selection of concepts in a simplified form that are further described below in the Detailed Description. This summary is not intended to identify key factors or essential features of the claimed subject matter, nor is it intended to be used as an aid in determining the scope of the claimed subject matter.

In various embodiments, methods and systems for curtain wall anchors are provided. In particular, various curtain wall anchor systems are described herein to streamline the process of placing curtain walls and to reduce labor time and cost associated with installation of curtain walls.

In a first embodiment, an anchor assembly is provided. The anchor assembly comprises a first vertical wall member and second vertical wall member connected by an arcuate web member and separated by a slot designed to engage a slab edge angle and an anchor channel configured for engagement with at least a portion of a curtain wall assembly, wherein the anchor channel is disposed opposite the first vertical wall member.

A second embodiment of an anchor assembly comprises a first vertical wall member and second vertical wall member connected by an arcuate web member and separated by a slot designed to engage a slab edge angle and a first vertically flange extending from the first vertical wall member and configured for engagement with at least a portion of a curtain wall assembly. Further embodiments and aspects will become apparent by reference to the drawings and by study of the following detailed description.

BRIEF DESCRIPTION OF THE DRAWINGS

Illustrative embodiments of the present invention are described in detail below with reference to the attached figures, which are incorporated by reference herein and wherein.

DETAILED DESCRIPTION

Figure 1:
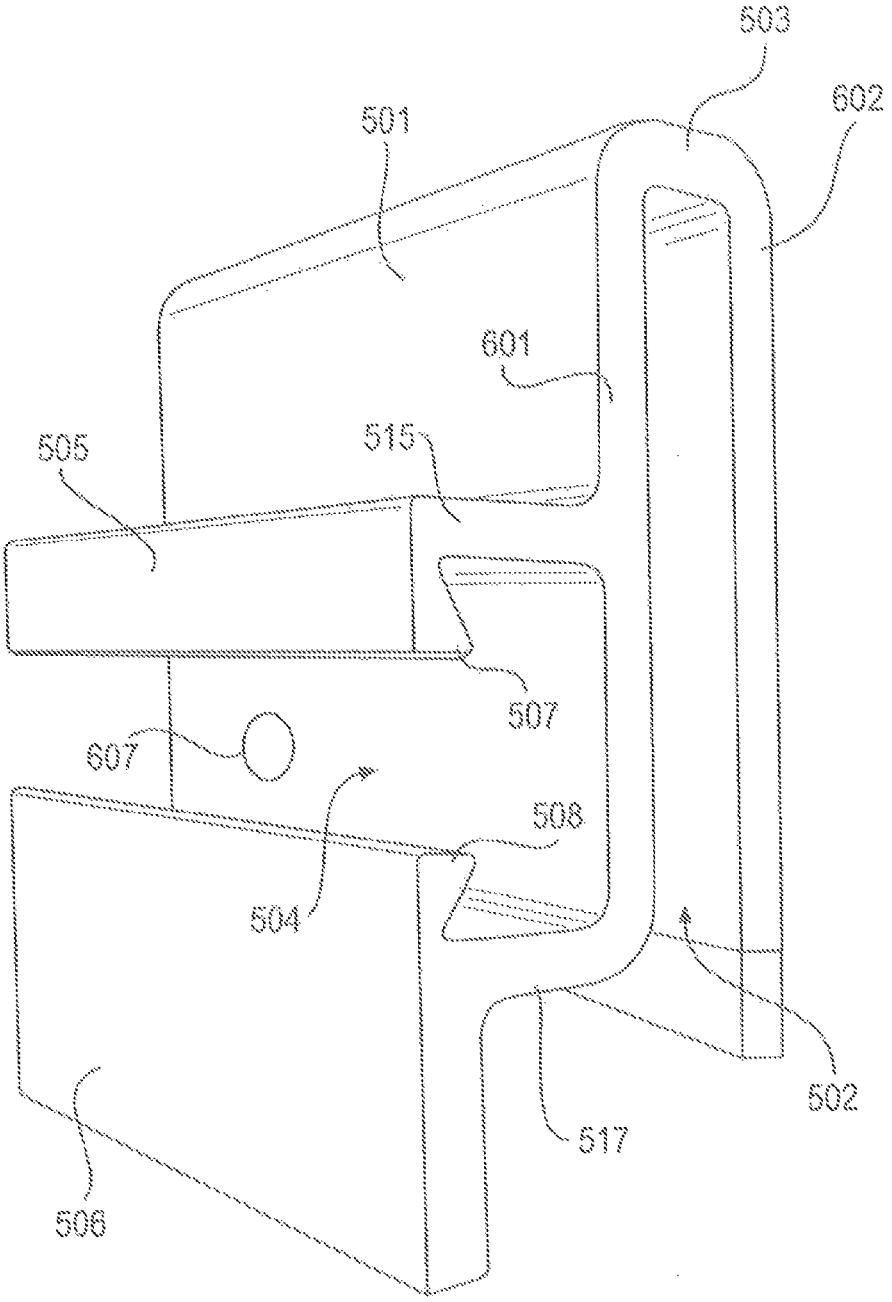
FIG. 1 depicts a perspective view of an embodiment of a curtain wall anchor system, in accordance with an embodiment of the present invention.

In the following detailed description, reference is made to the accompanying drawings, which form a part hereof and illustrate exemplary embodiments of the invention. In the drawings, reference numerals describe substantially similar components throughout the several views. These embodiments are described in sufficient detail to enable those skilled in the art to practice the inventions, and it is to be understood that other embodiments may be utilized, and that structural, logical, and procedural changes may be made.

Figure 2:
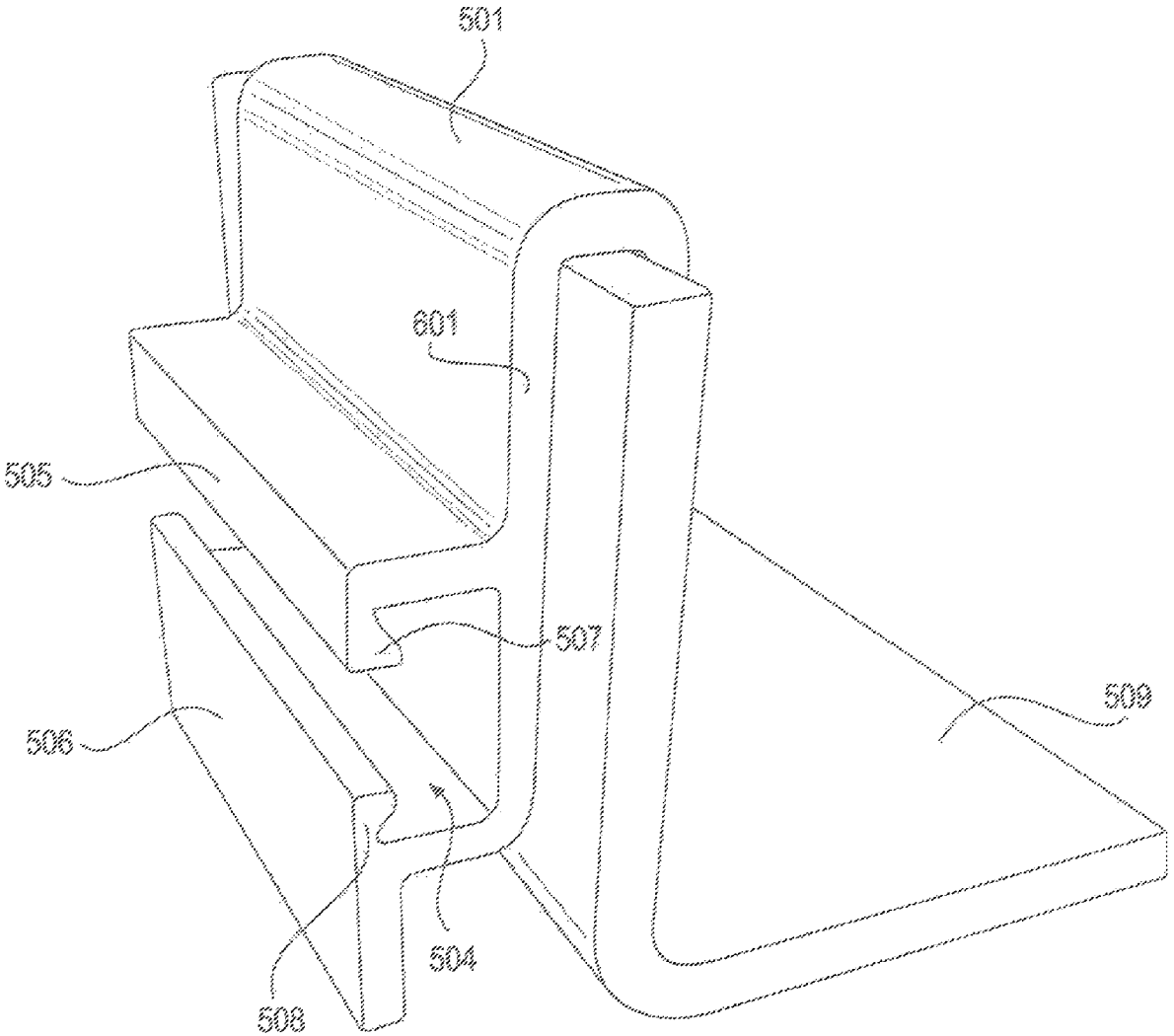
FIG. 2 depicts a perspective view of an embodiment of a curtain wall anchor system, in accordance with an embodiment of the present invention.

Various embodiments of a curtain wall anchor are illustrated in FIGS. 1-6. FIG. 1 an embodiment of a curtain wall anchor 501 that overhangs a concrete slab edge angle 509, as seen in FIG. 2. The curtain wall anchor utilizes an edge angle slot 502 terminating at a slot web member 503 to positively engage the edge angle hangar 501 with the edge angle 509. The web member 503 which is preferably arcuate in configuration but may also be of an orthogonal configuration, joins a first wall member 601 and a second wall member 602. As with the previous embodiment, the edge angle hangar 501 incorporates an anchor channel 504 with a first locking flange 507 and a second locking flange 508 positioned between a first face 505 and a second face 506.

The anchor channel 504 extends outwardly from the first wall member 601 of the edge angle hangar 501. The anchor channel is further comprised of outwardly extending upper and lower segments 515, 517. Extending downwardly from the upper segment 515 is the upper locking flange 507 and extending upwardly from the lower segment 517 is the lower locking flange 508. These two locking flanges 507, 508 serve to facilitate only longitudinal translation of the bolt (not shown). This embodiment of the edge angle hangar 501 preferably utilizes a through hole 607 in the first wall member 601 to facilitate the passage of a connector through to the second wall member 602.

Figure 3:
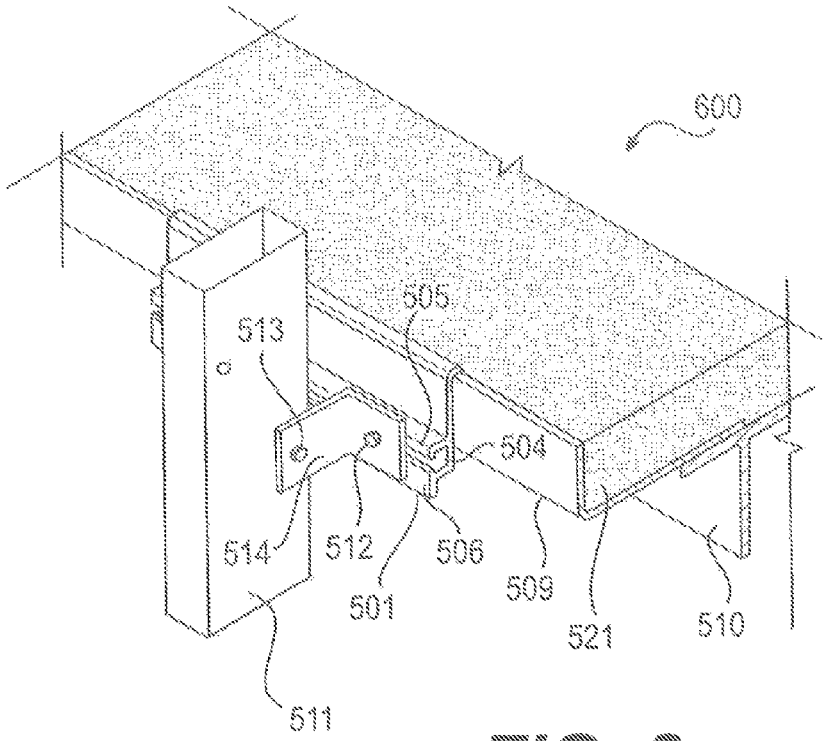
FIG. 3 a perspective view of an embodiment of a curtain wall anchor system, in accordance with an embodiment of the present invention.

While the edge angle hangar 501 provides for horizontal adjustable anchor attachment it does not replace the edge angle concrete pour stop. Rather, the edge angle hangar 501 is configured to hang onto, or more precisely over, the commonly used edge angle pour stops, as illustrated in FIGS. 2 and 3. The edge angle hangar 501 is "hanging over" or attached to an edge angle 509.

FIG. 3 details a perspective view of the curtain wall anchor system 600 in position. Here, the edge angle hangar 501 is illustrated as attached to the edge angle 509. The edge angle 509 overlays the structural steel support member 510 and is secured beneath the concrete slab 515. FIG. 3 illustrates a curtain wall attachment bracket 514 secured to the anchor channel 504 of the edge angle hangar 501 via an anchor bolt 512. An additional bolt 513 secures the curtain wall bracket 514 to a curtain wall assembly 511.

Figure 4:
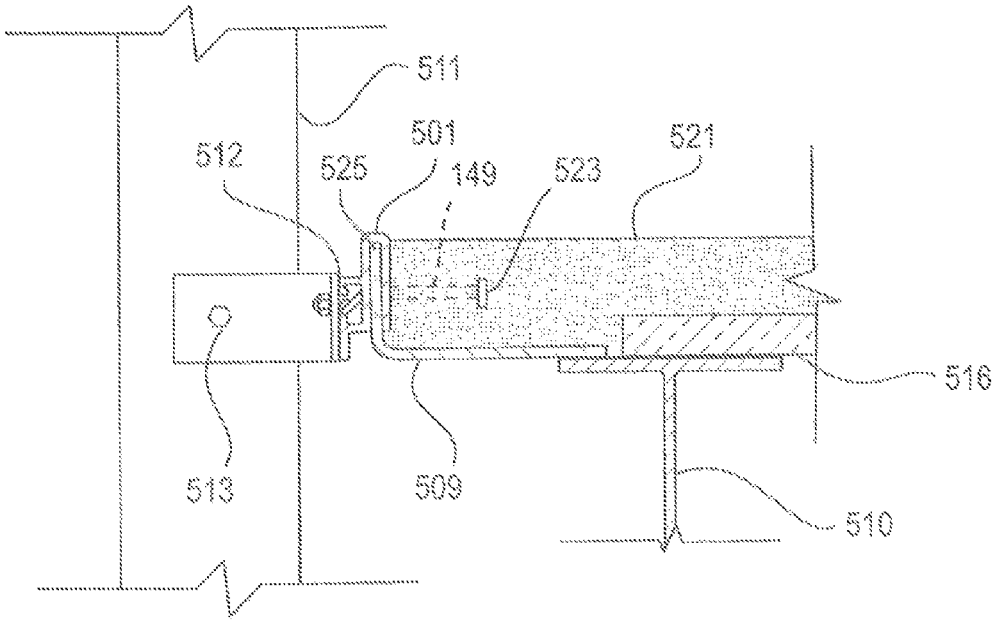
FIG. 4 depicts an elevation view of an embodiment of a curtain wall anchor system, in accordance with an embodiment of the present invention.

FIG. 4 details a side elevation view of the curtain wall anchor system 600. The elevation view details the edge angle hangar 501 positioned on the edge angle 509 such that the edge angle 509 is inserted into the edge angle slot 502 and secured in position on each side via the first and second wall members 601, 602. Metal decking 516 disposed beneath the concrete floor system is also detailed in FIG. 4. This same FIG. 4 further details the optional utilization of a headed-stud concrete anchor 523 or a reinforcing bar 149 embedded within the concrete slab 521 as needed to transfer loads from the anchor system into the concrete slab.

Figure 5:
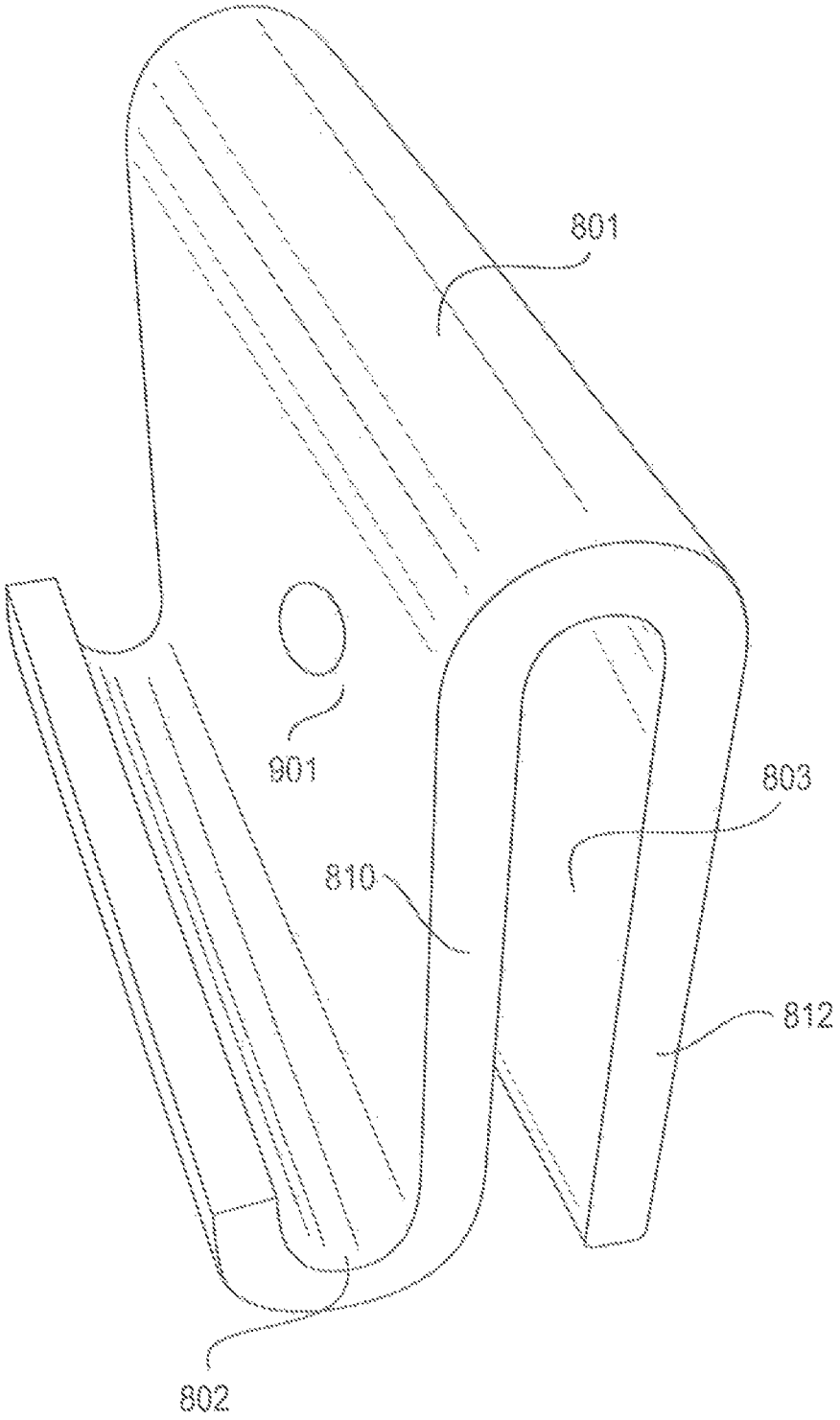
FIG. 5 depicts a perspective view of an embodiment of a curtain wall anchor system, in accordance with an embodiment of the present invention.
Figure 6:
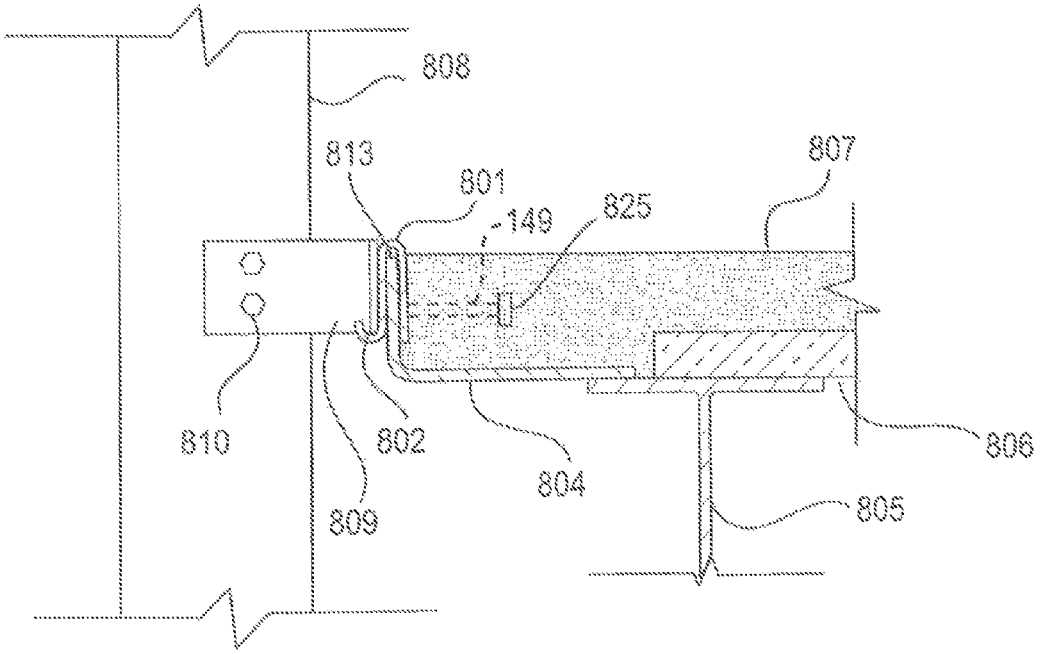
FIG. 6 depicts an elevation view of an embodiment of a curtain wall anchor system, in accordance with an embodiment of the present invention.

Another embodiment of an anchor attachment is detailed in FIGS. 5-6. FIG. 5 details a J-hook hangar 801 configured to slide over an edge angle, as seen in FIG. 6 at reference number 804, using a full length slot 803 bounded by a forward leg 810 and a rear leg 812. The forward leg 810 transitions into the J-flange 802 following an arcuate bend of 180 degrees. The J-flange 802 and the full length slot 803 may be adjusted to accommodate any size of edge angle 804 (to engage with the full length slot 803) and curtain wall attachment fittings (to engage with the J-flange 802). FIG. 5 further reveals a hole 901 that extends through forward leg 810 and also through rear leg 812 (not shown). These aligned holes are utilized to receive a screw anchor (not shown) that passes through the forward leg, through a hole in the edge angle 804 that is inserted into the full length slot 803, and finally into the hole of the rear leg 812. The use of a screw anchor is well known in the industry and in this instance serves to create a direct load path between the legs of the hangar 810, 812 and the edge angle 804 to provide structural rigidity in instances where for example, wind loads, are substantial.

FIG. 6 details an elevation view of the same embodiment detailed in FIG. 5. As in previous embodiments, the J-hook hangar 801 full length slot 803 is illustrated receiving an edge 813 of the angle member 804. The edge angle member 804 may be adjacent to a structural steel support member 805, such as an I-beam, and disposed beneath the concrete slab 807. Metal decking 806 is also shown disposed adjacent the edge angle member 804. The J-flange 802 is shown as attached to a curtain wall bracket 809 that is in turn attached to a curtain wall assembly 808 with at least one bolt 810.

FIG. 6 further details the optional use of headed stud anchor 825 or reinforcing bar anchor 149 embedded within the concrete slab 807 and with a second end 830 engaged to the inside face of rear leg 812. The reinforcing bar/anchor 149 or headed stud anchor 825 facilitates the appropriate transfer of loads into the concrete floor.

In each embodiment of the designated embodiments, installation of the curtain wall will be quicker and less costly by eliminating positioning and welding of curtain wall anchors to the traditionally used steel edge angle pour stops. The disclosed embodiments make horizontal adjustment of anchors quicker and simpler than with previous installation techniques. These designs thereby reduce the need for thicker steel edge angles required by structural designers for supporting eccentric curtain wall loads. Lastly, this design eliminates the need for studs or reinforcing welds to the edge angle to transfer eccentric loads from the curtain wall into the concrete slab.

In each of the described embodiments, where applicable, anchor channels may be customized to accommodate a variety of curtain wall attachment fittings and/or bolts. Additionally, each anchor assembly described herein may be made of steel or any other material that can sufficiently sustain the load associated with the particular situation. For example, a load for a construction project of a 15-story building will certainly differ from the load to withstand in a construction project of a 2-story building.

While the preferred form of the present invention has been shown and described above, it should be apparent to those skilled in the art that the subject invention is not limited by the figures and that the scope of the invention includes modifications, variations, and equivalents which fall within the scope of the attached claims. Moreover, it should be understood that the individual components of the invention include equivalent embodiments without departing from the spirit of this invention.

It will be understood by those of ordinary skill in the art that the order of the steps recited herein is not meant to limit the scope of the present invention in any way and, in fact, the steps may occur in a variety of different sequences within embodiments hereof. Any and all such variations, and any combinations thereof, are contemplated to be within the scope of embodiments of the present invention.

The invention claimed is:

1. An edge angle hangar apparatus for use in a curtain wall system, the edge angle hangar comprising:

an integral anchor channel with a back wall and an upper and lower segment and each segment extending outwardly from the back wall and terminating in a locking flange at a distal end of each segment, the anchor channel extending the length of the edge angle hangar;

a first face longitudinally coterminous with and extending perpendicular to the upper segment at the distal end and a second face coterminous with and extending perpendicular to and downwardly from the distal end of the lower segment;

a first wall member with an interior surface and an exterior surface, the upper segment extending outwardly from the first wall member roughly bisecting the first wall member into an upper portion and a lower portion wherein the lower portion is the back wall; and a second wall member with an interior surface and an exterior surface, the interior surfaces of the first and second wall members separated by an edge angle slot and connected at a web member, wherein the exterior surface of the first wall member is coextensive with the back wall of the anchor channel.

2. The edge angle hanger of claim 1, wherein the second face is of greater surface area than the first face.

3. The edge angle hangar of claim 1, wherein each of the first and second wall members include at least one through hole for receiving a fastener, the fastener further configured to pass through the hole in the second wall member, through a hole in the edge angle and then through the hole in the first wall member thereby allowing the first and second wall members and the edge angle to be secured to one another by the fastener creating a direct load path to the edge angle.

4. The edge angle hanger of claim 1, wherein a first end of a reinforcing bar is secured to the exterior surface of the first wall member.

5. The edge angle hangar of claim 4, wherein a second end of the reinforcing bar is embedded within a concrete slab.

6. A system for mounting a curtain wall to the exterior structure of a building, the system comprising:

a hangar apparatus further comprising;

i) an anchor channel with a back wall, the anchor channel extending the length of the hangar apparatus, wherein the anchor channel further comprises an upper segment and a lower segment extending outwardly from the back wall and both the upper segment and the lower segment terminating in a locking flange, the anchor channel configured for engagement with a first panel of a curtain wall bracket;

ii) a first wall member with an interior surface and an exterior surface and upper and lower ends;

iii) a second wall member with an interior surface and an exterior surface and upper and lower ends, the upper ends of the first and second wall members connected at a web member, the first and second walls forming a receiving slot and, wherein the exterior surface of the first wall member is coextensive with the back wall of the anchor channel;

an edge angle with a vertically oriented member;

a curtain wall assembly;

wherein the vertically oriented member of the edge angle is received into the receiving slot of the hangar apparatus and the first panel of the curtain wall bracket is mounted to the integral anchor channel of the hangar apparatus and a second panel of the curtain wall bracket is mounted to the curtain wall assembly thereby providing a path to transfer the load of the curtain wall and wind loads from the curtain wall assembly to the edge angle.

7. The system of claim 6, wherein the vertically oriented member of the edge angle serves as the edge of a poured concrete slab.

8. The system of claim 7, wherein at least one reinforcing bar with a first end disposed within the concrete slab and the second end of the reinforcing bar secured to the exterior surface of the second wall member.

9. The system of claim 8, wherein the first end of the at least one reinforcing bar passes through a hole in each of the second wall member, the edge angle and the first wall member thereby securing the hangar apparatus directly to the edge angle.

10. The system of claim 6, wherein the locking flanges of the upper and lower segments engage a portion of a first anchor bolt disposed within the anchor channel thereby preventing withdrawal of the anchor bolt from the anchor channel.

11. The system of claim 10, wherein the first anchor bolt disposed within the anchor channel is capable of translation along the longitudinally extending anchor channel until secured in position.

12. The system of claim 11, wherein a second anchor bolt passes through a hole in the second panel of the curtain wall bracket and into the curtain wall assembly thereby securing the curtain wall bracket to the curtain wall assembly.

13. A system for securing a curtain wall to the exterior structure of a building, the system comprising:

a curtain wall hangar further comprising;

i) a longitudinally extending anchor channel with a back wall, the anchor channel extending the length of the hangar, wherein the anchor channel further comprises an upper segment and a lower segment extending outwardly from the back wall and both the upper segment and the lower segment terminating in a locking flange;

ii) a first wall member with an interior surface and an exterior surface and upper and lower ends;

iii) a second wall member with an interior surface and an exterior surface and upper and lower ends, the upper ends of the first and second wall members conjoined at an arcuate web member, the first and second walls forming a receiving slot and, wherein the exterior surface of the first wall member is coextensive with the back wall of the anchor channel;

a curtain wall assembly an edge angle with a vertically oriented member;

a curtain wall bracket further comprising a first panel and a second panel;

wherein the vertically oriented member of the edge angle is received into the receiving slot of the curtain wall hangar and the first panel of the curtain wall bracket is secured to the anchor channel of the curtain wall hangar and the second panel of the curtain wall bracket is secured to the curtain wall assembly.

14. The system of claim 13, wherein the locking flanges of the upper and lower segments engage a portion of a first anchor bolt disposed within the anchor channel thereby preventing withdrawal of the anchor bolt from the anchor channel.

15. The system of claim 14, wherein the first anchor bolt disposed within the anchor channel is capable of translation along the longitudinally extending anchor channel until secured in position.

* * * * *